United States Patent [19]

Walter

[11] Patent Number: 4,615,447

[45] Date of Patent: Oct. 7, 1986

[54] SECURITY GARMENT DISPLAY STAND

[75] Inventor: Herbert Walter, Müllheim, Fed. Rep. of Germany

[73] Assignee: Protoned B.V., Amsterdam, Netherlands

[21] Appl. No.: 775,730

[22] Filed: Sep. 13, 1985

[30] Foreign Application Priority Data

May 8, 1985 [CH] Switzerland ..... 1955/85

[51] Int. Cl.[4] ..... E05B 73/00

[52] U.S. Cl. ..... 211/4; 211/8; 70/59; 70/60; 223/85; 223/92; 223/95

[58] Field of Search ..... 211/4, 7, 8; 70/59, 70/60, 57, 58; 223/85, 92, 93, 95, 96

[56] References Cited

U.S. PATENT DOCUMENTS

| | | | |
|---|---|---|---|
| 1,118,497 | 11/1914 | Klimczyk | 211/8 |
| 1,618,885 | 2/1927 | Minor | 211/8 |
| 2,017,944 | 10/1935 | Braley | 223/85 |
| 2,584,046 | 1/1952 | Peters | 211/8 |
| 3,014,593 | 12/1961 | Risely et al. | 211/4 |
| 3,647,072 | 3/1972 | Strang | 211/4 |
| 4,076,126 | 2/1978 | Gillmour | 211/4 |
| 4,088,228 | 5/1978 | Schwalbe | 211/4 |
| 4,204,601 | 3/1980 | Thomas | 211/4 |
| 4,540,092 | 9/1985 | DeSantis | 211/4 |

*Primary Examiner*—Cornelius J. Husar
*Assistant Examiner*—Douglas W. Hanson
*Attorney, Agent, or Firm*—Ladas & Parry

[57] ABSTRACT

Holding rods (4) are mounted to swing on a supporting device (1 to 3), the upper end portion (4.1) of which rods is inclined upwards at an angle α between 10° and 30° to the horizontal. On each of these upper end portions (4.1) there can be put a coat hanger (5), which is intended to receive a garment to be displayed. For this purpose the coat hanger (5) is provided with a reception opening (9), which is formed along one of the two carrier arms (5.1), in its interior. The end portion (4.1) is provided with a circumferential latching groove (42), in which the bolt (46) of a locking device (10) is intended to engage, when the coat hanger (5) has been fully pushed onto the holding rod (4) up to an end abutment (49). The coat hanger (5), together with the garment on it, can only be removed from the holding rod (4) after unbolting of the locking device (10) has been effected.

For display of garment combinations with garments for the legs, the coat hanger (5) can be provided with a trousers bar (13), the security of the garment for the legs then being effected by means of a trousers security device (14), the latching action of which with respect to the trousers bar (13) can be removed in combination with the release of the coat hanger locking device (10).

18 Claims, 10 Drawing Figures

Figure 3:
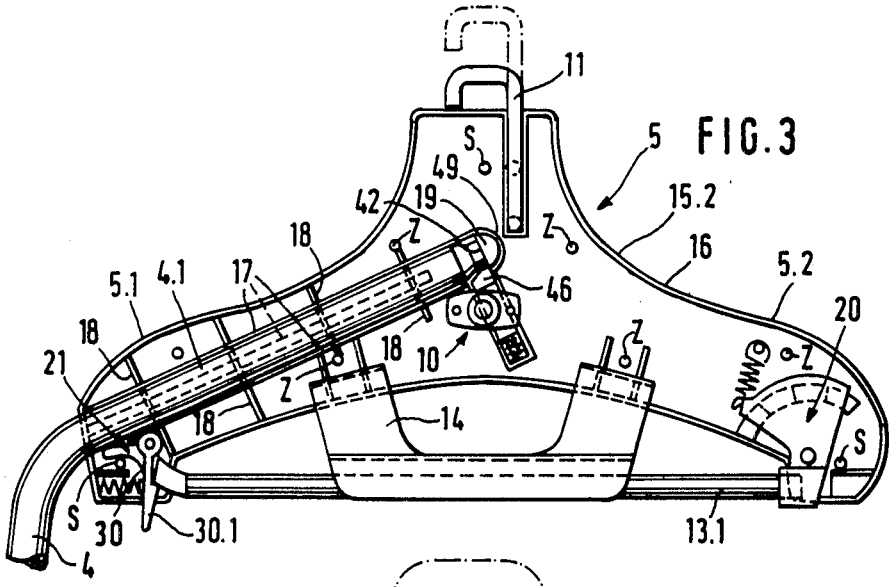

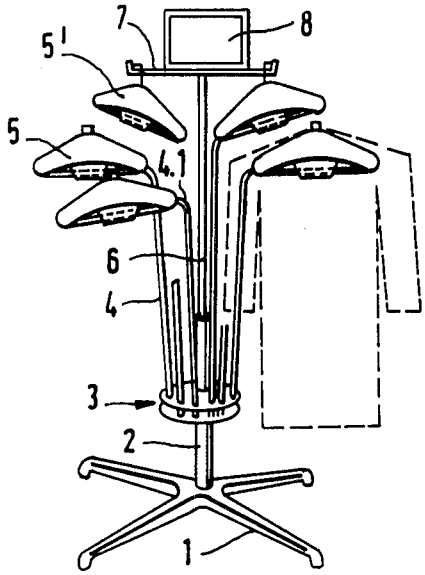
FIG. 1
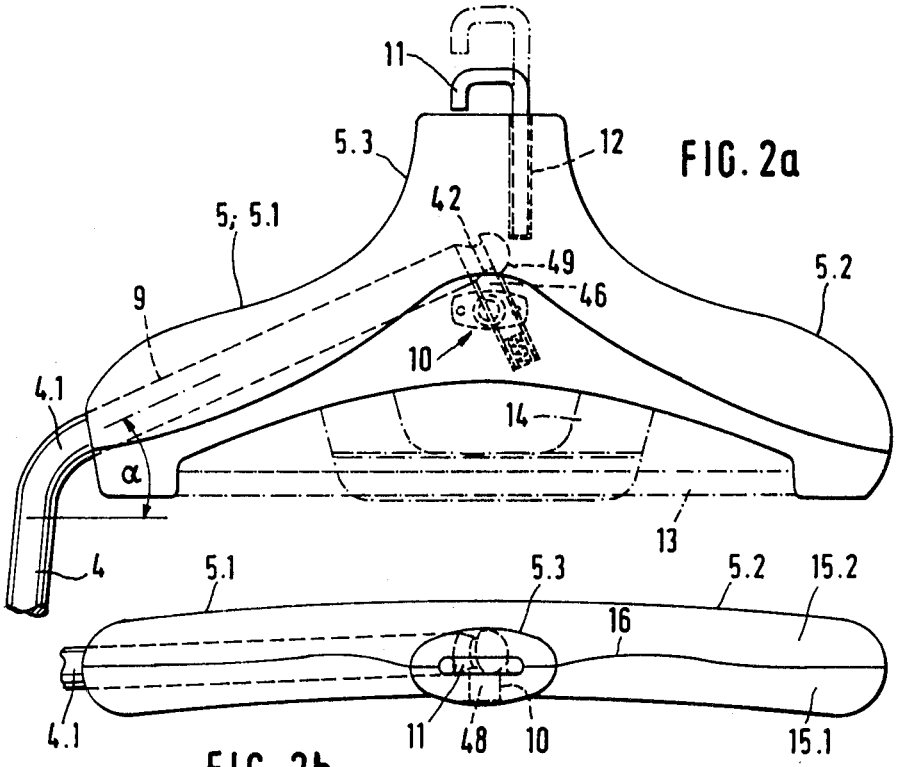
FIG. 2a
FIG. 2b

SECURITY GARMENT DISPLAY STAND

The invention relates to a security garment display stand according to the preamble of claim 1. Garment display stands of this kind make it possible to show even relatively expensive garments such as fur coats and leather clothing in sales and exhibition areas, in a manner thoroughly secure against theft, without continuous watch by members of staff.

In Swiss Patent (Application No. 5825/83) a security garment display stand is described, in which at the upper ends of holding rods, which are secured to swing in a supporting device near the floor, there is present in each case a snap-in latch for $ecure retention of a coat hanger. The latter, together with the associated holding rod, constitutes a carrier device for a garment, which can only be taken away from the display stand after release of the snap-in latch and lifting off of the coat hanger from the holding rod. The release of the snap-in latch occurs by means of a key which is accessible only to the sales staff.

Although this security garment display stand is simple to handle, and the security against unauthorised removal of garments is very discreet to operate, the snapin latch at the upper end of the holding rod limits the form of the coat hanger to certain types of garment, e.g. coats or jackets. In particular the secure reception of combinations with garments for the legs involves problems. In addition, the removal of heavy garments from the security device imposes high physical demands for people of small stature or those who are not robust, especially if many garments are to be lifted off one after another.

The present invention thus has two requirements to satisfy:

1. a security garment display stand of the kind stated initially shall be provided, with which, together with draped-round garments such as coats, jackets or robes, combinations of garments for the legs such as overall leather garments including trousers, can also be displayed, and 2. the coat hanger, upon removal from being supported by the holding rod, should have to be moved substantially horizontally or only slightly obliquely upwards, in order to keep the exertion of force to a minimum.

The solution of this object, according to the invention, can be gathered from claim 1. Embodiments thereof appear from the dependent claims 2 to 18.

The invention is described below by way of example, with reference to the drawing in which:

FIG. 1 shows an embodiment of the security garment display stand according to the invention, formed as a circular stand, schematically and in perspective view, FIGS. *2a, 2b* show an embodiment of a coat hanger which can be used with the security garment display stand, in front view (a) and in plan (b).

Figure 4C:
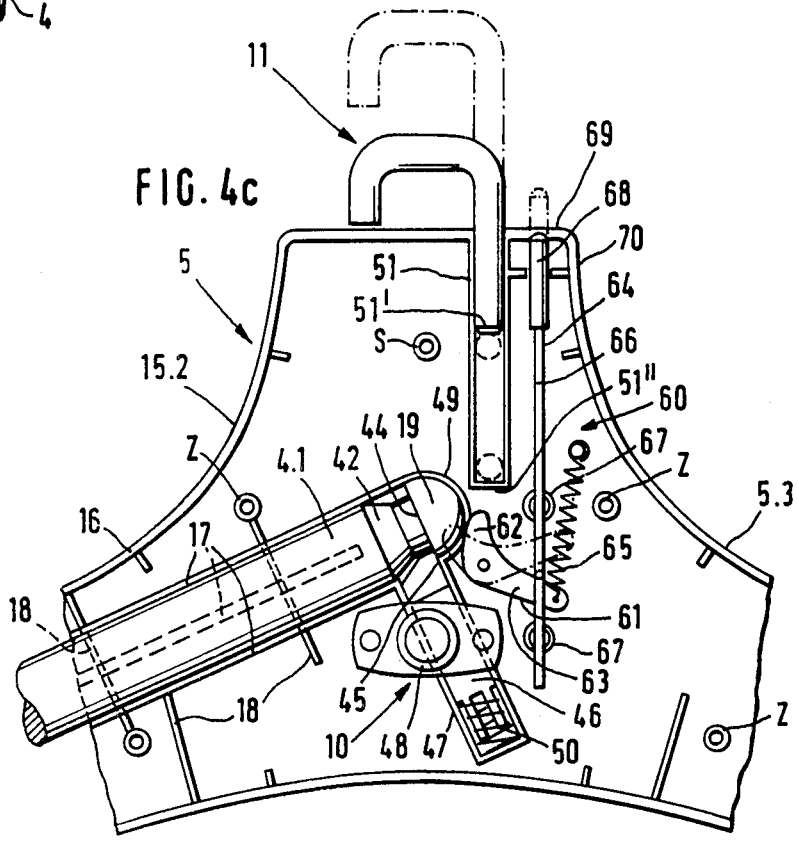
Figures 4A, 4B, 5, 6A, 6B:
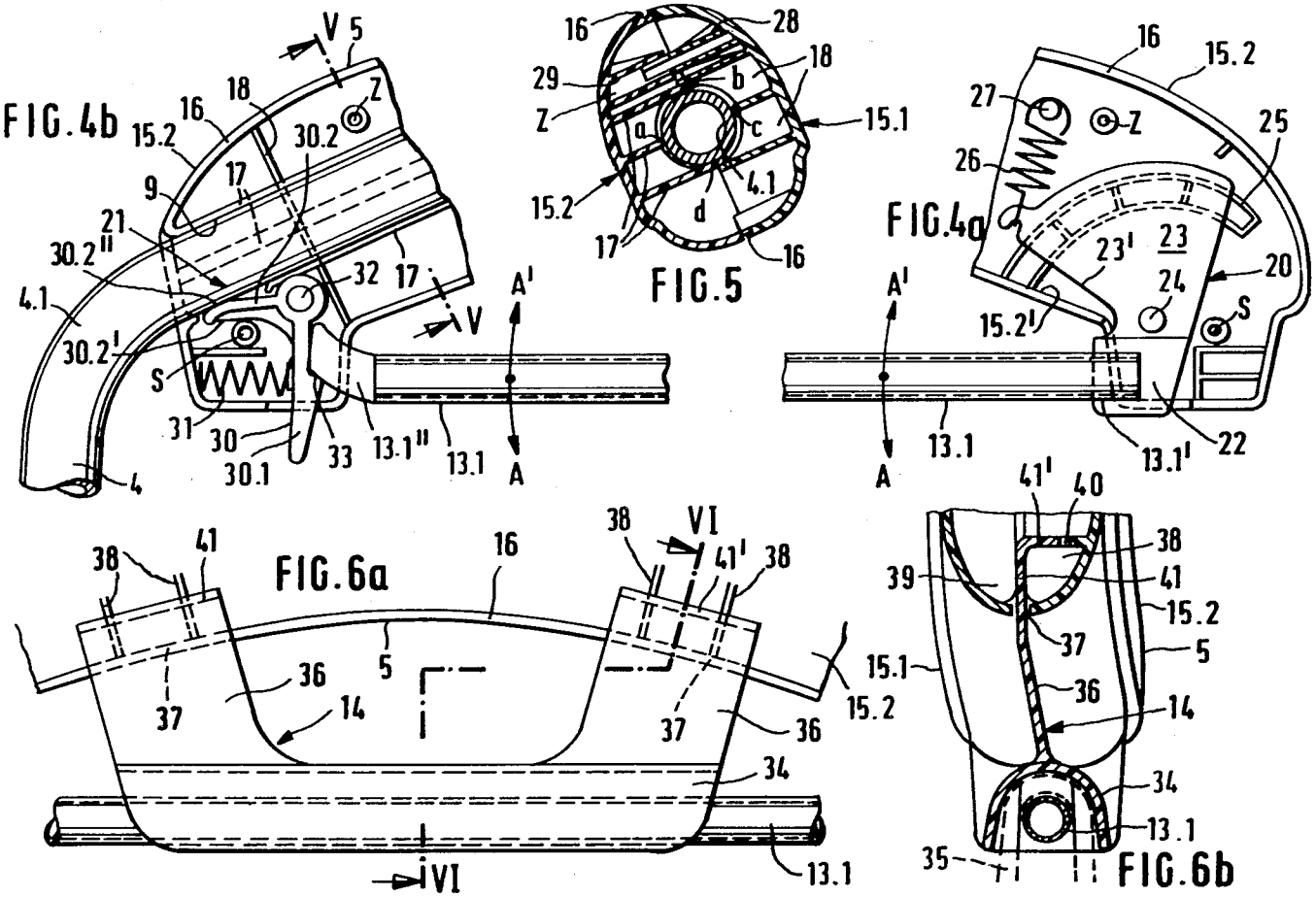

FIG. 3 shows the coat hanger similar to that according to FIG. *2a,* in vertical section, in a variant with a hollow body, FIGS. *4a, 4b, 4c* show enlarged detail views of the swinging mounting (a) and the locking (b) of a trousers bar, and also the coat hanger security arrangement (c) of the embodiment according to FIG. 3, FIG. 5 shows a section on the line V—V in FIG. *4b,* and FIGS. *6a, 6b* show enlarged detail views of the security arrangement for the trousers support in side view (a) and in section on the line VI—VI (b).

The circular stand according to FIG. 1, provided in known manner with a star-shaped supporting foot 1 and a supporting tube 2 mounted on it, is provided with a carrier arrangement 3 which is preferably rotatable like a roundabout (if necessary adjustable vertically). On the carrier arrangement 3 there are mounted a number of holding rods 4 (only some of which are shown), the rods being suitably peripheral, fixed at substantially equal circumferential intervals, and rotatably arranged, and on their upper ends 4.1 in each case there sits removably a coat hanger 5, e.g. formed according to FIG. *2a.* In axial prolongation of the supporting tube 2, there is suitably provided a central rod 6, which carries at its upper end a cross member 7, which can be used for hanging up empty coat hangers 5' during trying on of garments. A frame-like label holder 8 can be mounted on the cross member 7.

It is clear that the circular stand according to FIG. 1 shows only one preferred embodiment of the subject of the invention. The carrier construction of the holding rods 4 and of their carrier arrangement 3 can, of course, be varied in many ways.

As shown in FIG. *2a,* the upper end 4.1 of the holding rod 4 is bent at an angle $\alpha$ to the horizontal, which preferably amounts to not more than about 30°. Smaller angles $\alpha$ of 10°–20° are preferred, for in that way lifting-off of the coat hanger 5 from the rod 4 can be facilitated. The coat hanger 5 can be formed as a solid body with a reception opening 9 for the upper end 4.1 of the holding rod 4, and also a receiving space for a latching lock 10 (shown in FIG. *2a* in broken lines) accessible from the front side of the hanger. The hanger body can also be provided with a hanging hook 11, which is anchored in the interior of the hanger body so as to be able to be pulled out, for example in a sleeve-like mounting 12. With reference to this, so that preferably heavy garments can be stored on such coat hangers, such as fur coats or leather garments, its thickness measurements are generously dimensioned, and the relevant supporting surfaces are well rounded. FIG. *2b* shows how a ground plan shape matching the body can be formed by a slight longitudinal curvature. Furthermore, the coat hanger body can be provided with a trousers bar 13 and if necessary a trousers security device 14 (both shown in FIG. *2a* in broken lines). The trousers bar 13 can be rigidly connected with the hanger body, or be arranged on it to swing (FIGS. 3, *4a, 4b*) or to shift (not shown).

The coat hanger body can also be formed as a hollow body constructed of two shell parts 15.1 and 15.2, e.g. of a plastics material, the abutting edges of the shell parts continuously merging into one another along a circumferential mating area 16. The two shell parts 15.1, 15.2 contain stiffening, centering and fixing elements in their interior, by which, together with a hanger body free from twist, an efficient assembly of the coat hanger 5 and its components can be ensured.

An exemplary embodiment of a coat hanger 5 with a hanger body of two shell parts 15.1, 15.2 is described below with reference to FIGS. 3, 4(*a–c*) and 5. What is shown is the "rear" shell part marked in FIG. *2b* as 15.2. The front shell part 15.1 has preponderantly ribs, guide elements and fixing members which are congruently formed (exception: the lock part). Circles marked S indicate places where the shell parts 15.1, 15.2 are held together with screws; circles marked Z indicate centralising pins by which the shell parts abutting in the mating area 16 are locked relative to one another. Furthermore, in this exemplary embodiment the coat hanger 5 is shown with a trousers bar 13.1 which can be swung downwards in the direction of the arrow A, and with a trousers security device 14 which can be incorporated in one or both of the shell parts 15.1, 15.2. Details of these construction elements are described with reference to FIGS. 4 (*a–c*) and 5.

FIGS. 3 and 4*b* show in side elevation and FIG. 5 in cross-section how the upper end 4.1 of the holding rod 4 is received in a guide zone constituted by two longitudinal rib arrangements 17, which are substantially symmetrical. Of the two longitudinal rib arrangements 17, one is in each of the shell parts 15.2 and 15.1. They are supported by transverse ribs 18 in the respective shell parts and guide the upper end 4.1 of the holding rod 4 in such a way that its head 19 reaches installed position fitting exactly in the locking device 10. Details of this are described with reference to FIG. 4*c*. A (right-side) swinging mounting 20 and a (left-side) retaining device 21 for the trousers bar 13.1 appear on a larger scale from FIGS. 4*a* and 4*b*, and are described below with reference to these Figures.

The right-hand end 13.1' of the trousers bar 13.1 sits firmly in a gripping socket 22, which is integrally connected to a sector-shaped guide plate 23 of the swinging mounting 20. The gripping socket and the guide plate are arranged to be movable around a pivot pin 24. The guide plate 23 is held between confining ribs 25, which are present in equal or similar arrangement in both the shell parts 15.2 and 15.1 (not shown). The swinging movement of the trousers bar 13.1 is limited in anticlockwise direction (arrow A in FIG. 4*a*) by abutment of the front side 23' against the shell part portion 15.2'. In order that the trousers bar 13.1 can be carried back at least into the neighbourhood of the leftside retaining device 21, when substantially unloaded, the swinging mounting 20 can be provided with a return tension spring 26, which is incorporated between the guide plate 23 and a tensioning pin 27 which is fixed to a shell part.

The centralising pin Z, the screw S and a holder (not shown) for the pivot pin 24, ensure the stability of the swinging mounting 20, and the confining ribs 25 establish the plane of movement of the trousers bar 13.1. If it is desired to have for the latter an ability to swing sideways also, instead of a predetermined vertical movement, then instead of the mounting 20 shown there can be provided a ball joint mounting (not shown) in which at the end 13.1' of the trousers bar 13.1 there is present an end part with a spherical surface, replacing the gripping socket 22, and in each of the shell parts 15.2 and 15.1 there is formed a half of a pivot socket with a spherical recess.

From FIGS. 4*b* and 5 can be seen on a larger scale how the longitudinal ribs 17 formed as guide elements for the upper end 4.1 of the holding rod 4 are formed integrally with the shell parts 15.1, 15.2 and in themselves are formed to produce a guide zone. In FIG. 5 is shown how the end 4.1 of the holding rod is centralised along four supporting areas a, b, c, d. Furthermore, there appears from this Figure a variant of the formation of the mating area 16, in which the meeting zones engage in one another, each with half the wall thickness or shell thickness. A variant Z of the centralising pin shows the interengagement of a thin tubular projection 28 from the shell part 15.1 into the bore of a further tubular projection 29 from the shell part 15.2.

The embodiment of the retaining device 21 shown in FIG. 4*b* includes as its main component a two-armed clamping lever 30, which can be swung around a pivot pin 32 against the compressive force of a spring 31. One spring-actuated lever arm 30.1, with a latching abutment 33, is intended for reception of the free end 13.1'' of the trousers bar 13.1, if this is in its swung-in position of use. The other lever arm 30.2 has, in the example shown, a double role: on the one hand the abutting of its under side 30.2' against the threaded pin S limits the swinging out of the clamping lever 30 in the anticlockwise direction, so that this is always in ready position if the trousers bar 13.1 is to be latched in position of use. On the other hand close contact of the upper side 30.2'' of the lever arm 30.2 with the surface of the upper holding rod end 4.1 while the latter is in the position pushed into the coat hanger 5 prevents the clamping lever 30 from being able to be swung in clockwise direction. In other words: the abutting of the lever arm 30.2 against the threaded pin S on the one hand ensures that, when the coat hanger 5 is pulled off the holding rod 4, the clamping lever 30 is at all times ready to hold the trousers bar 13.1 firmly upon swinging in (arrow direction A'). On the other hand, when the coat hanger 5 is placed on the holding rod 4/4.1, the movement barrier for the clamping lever 30 prevents the trousers bar 13.1 from being released and a garment lying on it from being taken away unobserved. From this there again results an optimum usefulness of the trousers bar 13.1 and automatic security of a garment laid upon it, when the coat hanger has been put in place.

FIG. 4*c* shows the central middle part 5.3 lying between the hanger portions according to FIGS. 4*a* and 4*b*, and lying at a higher level in the coat hanger. This contains the locking device indicated generally at 10, the pull-out hanging hook 11, and a mechanical-optical security indicating device indicated generally at 60. Similarly to FIG. 4*b*, 15.2 indicates the rearward shell part, 16 the mating area with respect to the other shell part 15.1 (FIG. 5), and 17, 18 the longitudinal and transverse ribs for guidance of the end portion 4.1 of the holding rod and for stiffening of the shell parts 15.1, 15.2. The screw positions for connection of the two shell parts are indicated at S, and the centralising pins for stabilisation of the hollow body of the coat hanger are indicated at Z. The outermost part of the end portion 4.1 of the holding rod is provided with a circumferential latching groove 42, onto which joins by its end the more or less spherically rounded entry head 19. The latching groove 42 is provided with a position-determining latching shoulder 44, with which the latching surface 45 of a bolt 46 attains engagement. The bolt 46 can be moved transversely to the latching groove 42 in a housing constituted by ribs 47, and can for example be brought into and out of engagement with the latching shoulder 44 of the latching groove 42 by a cylinder lock 48. The end position of the entry head 19 is determined by an abutment part 49 connected to the long tudinal ribbing 17, so that an end position is given which is practically free of play. Suitably the bolt 46 is under the prestress of a spring 50, so that if necessary only the releasing action must be controlled by the cylinder lock 48, but locking comes about by snap engagement.

The hanging hook 11 is so guided in longitudinal ribbing 51 that its longitudinal central plane comes to lie in the dividing plane between the shell parts 15.1, 15.2.

.A transverse rib 51' establishes the upper end, and a transverse rib 51'' the lower end of the pulling-out travel of the hanging hook 11. This embodiment can take part in place of the sleeve guide for the hanging hook 11 described above.

As additional security means against possible non-locking or insufficient pushing of the coat hanger onto the end 4.1 of the holding rod, a mechanical-optical indicating device 60 can be present. This includes a feeler element in the form of a two-armed lever 61, one (shorter) lever arm of which serves as a feeler member 62 which can be brought into engagement with the entry head 19 bf the end portion 4.1 of the holding rod. The other (longer) lever arm is formed as the actuating member 63 of an indicator element 64. The feeler member 62 is pressed against the entry head 19 by a tension spring 65 tensioned to the actuating member 63. An indicator rod 66, coupled to the actuating member 63 and mounted by guide columns 67 to be displaceable, carries at its upper end a thickened cap 68, which is effective as a signal element by appropriate colouring. The cap 68 passes through the upper wall 69 at the neck 70 of the coat hanger. When the coat hanger 5 has been fully pushed onto the end portion 4.1 of the holding rod, the lever 61 is urged into its position shown in full lines, by which the indicator rod 66 is drawn downwards and the cap 68 sinks below the surface of the upper wall 69. When the coat hanger 5 has been pulled off the end portion 4.1 of the holding rod, or has been less than fully fitted onto it, and there is hence an unlocked condition, the lever 61, under the influence of the spring 65, is in the position shown in broken lines. In this case the indicator rod 66 has also moved so far outwards that the cap 68 projects above the upper wall 69, as shown in broken lines.

Such signalling of the condition of security of the coat hanger on its holding rod enables the sales staff to establish whether the coat hangers have been secured, without conspicuous manual checking.

A preferred embodiment of the trousers security device has already been mentioned above, and is shown in FIGS. *2a* and 3 at 14. A detailed representation is given by FIGS. *6a* and *6b*, in which are shown an elevation and a section on the line VI—VI in FIG. *6a*. This trousers security device 14 is preferably made integrally and comprises an inverted-U-shaped channel portion 34, which covers the trousers bar 13.1 at a spacing, like a hood. This spacing is adjustable if desired to the garments 35 to be displayed (shown in broken lines) and lies in the range 6–10 mm. Carrying straps 36 are formed on the longitudinal ends of the channel portion 34, and these straps are directed towards slots 37 in the mating area 16, and pass through it. In the interior of the shell parts 15.1, 15.2 there are stiffening bars 38, 39 which lie opposite one another at a spacing equal to the thickness of the carrying straps 36. At least the stiffening bars 38 in the shell part 15.2 each contain a groove 40 of the width of an anchoring portion 41 on the carrying straps 36, with an end 41' bent more or less at right angles.

Thus the trousers security device 14, which suitably is made as a separate component, can, without additional elements, be arranged and incorporated or removed as desired.

I claim:

1. Security garment display stand with a supporting device (1 to 3) and a number of holding rods (4) in swinging connection to the supporting device, each for lockable reception of a coat hanger (5) with two carrier arms (5.1, 5.2) projecting sideways and a central middle portion (5.3), characterised in that the holding rods (4) have an end portion (4.1) which can engage in one (5.1) of the two carrier arms, and is inclined upwards at an angle ($\alpha$) of 10° to 30° to the horizontal, that one carrier arm (5.1) of the coat hanger (5) has an opening (9) penetrating this arm in its longitudinal direction, for reception of the end portion (4.1) of the holding rod, that this end portion has a latching groove (42) for engagement of a bolt (46) releasable by a locking device (10), that the receiving opening (9) is provided with an abutment part (49) for determining the depth of penetration of the end portion of the holding rod into the carrier arm (5.1) of the coat hanger (5), and that, in relation to the end portion (4.1) of the holding rod, the coat hanger (5) is arranged to swing on it.

2. Garment display stand according to claim 1, characterised in that the coat hanger (5) is provided with a trousers bar (13) inserted between the end portions of the carrier arms (5.1, 5.2), and with a trousers security device (14), which reaches in channel shape (34) round the trousers bar, on its upper side and laterally, over at least part of its length.

3. Garment display stand according to claim 2, characterised in that one end (13.1') of the trousers bar (13.1) is mounted to swing out in the end portion of one of the carrier arms (5.2), and the other, free end (13.1'') can be latched in the end portion of the other carrier arm (5.1) in a clamping device (30 to 33).

4. Garment display stand according to claim 1, characterised in that the coat hanger (5) is formed as a hollow body out of two matching shell parts (15.1, 15.2) connected together, which are aligned with each other by individual centralising pins (Z) and a circumferential mating area (16).

5. Garment display stand according to claim 3, characterised in that the clamping device for latching the free end (13.1'') of the trousers bar (13.1) comprises a two-armed clamping lever (30) which can be actuated manually against a spring (31), which lever can swing around a pivot pin (32), and that one lever arm (30.1) has a latching detent (33) receiving the free end (13.1'') of the trousers bar (13.1) under spring pressure, and the other lever arm (30.2) is provided with an abutment surface (30.2) for limiting the movement travel of the clamping lever (30).

6. Garment display stand according to claim 4, characterised in that the opening (9) for reception of the end portion (4.1) of the holding rod is established by the free end parts (a, b, c, d) of longitudinal ribs (17) connected to the shell parts (15.1, 15.2), and that the longitudinal ribs (17) are stiffened by transverse ribs (18) likewise connected to the shell parts (15.1, 15.2) and arranged at intervals from each other.

7. Garment display stand according to claim 6, characterised in that at least a part of the longitudinal ribs (17) are connected at their inner end to the abutment part (49) for the entry head (19) on the end portion (4.1) of the holding rod.

8. Garment display stand according to claim 5, characterised in that the other lever arm (30.2) has, on its side facing the reception opening (9) for the end portion (4.1) of the holding rod, a surface portion (30.2''), which, when a coat hanger (5) has been placed on the said end portion, engages with this surface portion, and blocks the clamping lever (30) which is latching the trousers bar (13.1).

9. Garment display stand according to claim 3, characterised in that the swinging mounting (20) of the trousers bar (13.1) is provided with a guide plate (23) determining the movement of the trousers bar in the vertical direction, which guide plate is movable about a pivot pin (24) and can be provided with a return tension spring (26), which is able to hold the trousers bar (13.1) in approximately horizontal position, at least in the unloaded condition.

10. Garment display stand according to claim 2, characterised in that the channel-shaped portion (34) of the trousers security device (14) is held at a distance above the trousers bar (13.1) by at least one carrier strap (36), engaging in the coat hanger (5; 15.1, 15.2) and anchored in it.

11. Garment display stand according to claim 4, characterised in that the carrier strap/straps (36) is/are introduced through a slot/slots (37) into grooves (40) of transverse stiffening bars (38) into the interior of the shell parts (15.1, 15.2), and is/are latched (FIG. 6*b*).

12. Garment display stand according to claim 1, characterised in that the bolt (46) of the locking device (10) is prestressed in the latching direction by a spring (50) and can only be moved out of its locked position in the latching groove (42) at the outer end of the end portion (4.1) of the holding rod by means of a security lock (48).

13. Garment display stand according to claim 12, characterised in that, in unactuated condition, the bolt (46) lies in the latching position (FIG. 4*c*).

14. Garment display stand according to claim 1, characterised by an indicator device (60) responding to the engagement of a reference zone on the end of the end portion (4.1) of the holding rod with the abutment part (49) of the reception opening (9), which device is intended to indicate optically the correct seating of the coat hanger (5) on the end portion (4.1) of the holding rod.

15. Garment display stand according to claim 14, characterised in that the said reference zone of the entry head (19) is at the outer end of the end portion (4.1) of the holding rod, and the indicator device (60) is a feeler member (62) which feels the position of the entry head (19).

16. Garment display stand according to claim 15, characterised in that the feeler member (62) is one lever arm of a two-armed lever (61), the other lever arm (63) of which actuates an indicator element (64).

17. Garment display stand according to claim 16, characterised in that the indicator element is a signal rod (66) provided with an end cap (68), which cap projects above the upper wall (69) of the coat hanger (5) when the coat hanger is not in secured condition on the end portion (4.1) of the holding rod.

18. Garment display stand according to claim 1, characterised in that the coat hanger (5) is provided with a hanging hook (11) mounted therein to shift longitudinally, in such a way that in the rest position the hanging hook attains a first pushed-in position under gravity, and can be brought into a second pulled-out position for external hanging up of the coat hanger.

* * * * *